340-566 SR
4/20/82 XR 4,326,196

United States Patent [19]
Plevy

[11] 4,326,196
[45] Apr. 20, 1982

[54] UNIVERSAL GRAVITY OPERATED INTRUSION SENSING DEVICE

[76] Inventor: Arthur L. Plevy, 9 Yorktown Rd., East Brunswick, N.J. 08816

[21] Appl. No.: 147,722

[22] Filed: May 8, 1980

[51] Int. Cl.[3] ..... G08B 13/08

[52] U.S. Cl. ..... 340/545; 200/61.47; 200/61.52; 200/61.93; 340/566; 340/689

[58] Field of Search ..... 340/545, 689, 566, 669, 340/665; 200/61.47, 61.52, 61.93, 61.62, 61.83, 61.71, 61.72, 61.73, 61.74, 61.75, 203, 204, 207, 215, 216, 217, 218, 220, 229

[56] References Cited

U.S. PATENT DOCUMENTS 2,070,683 2/1937 Price ..... 200/61.83
3,499,131 3/1970 Gutting ..... 340/545

*Primary Examiner*—Glen R. Swann, III

[57] ABSTRACT

A gravity operated intrusion sensing device comprises a mercury tilt switch having at least two operating modes and a stationary housing having means operative to support the tilt switch in a first position indicative of one operating mode and to provide a second position indicative of another operating mode. The switch is responsive to an external force applied to the housing and falls under the influence of gravity as constrained by the housing to the second position. The entire switch actually falls freely within the stationary housing as to the second position. The second position as dictated by the housing produces a tilted plane at which the switch, after falling, comes to rest, thus assuring the proper operating angle to cause the proper tilt so that in the second position the switch will be in a completely different state, as opened or closed, as compared to the state in the first position.

10 Claims, 9 Drawing Figures

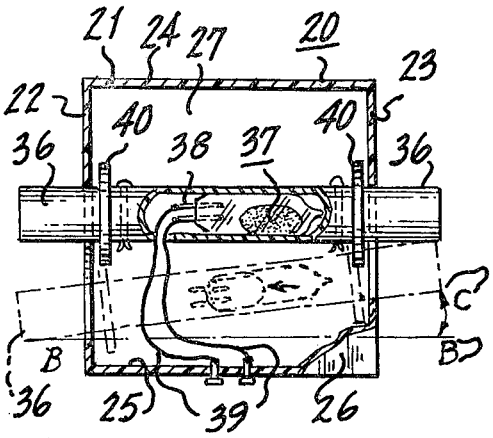
Fig.1
Fig.3A
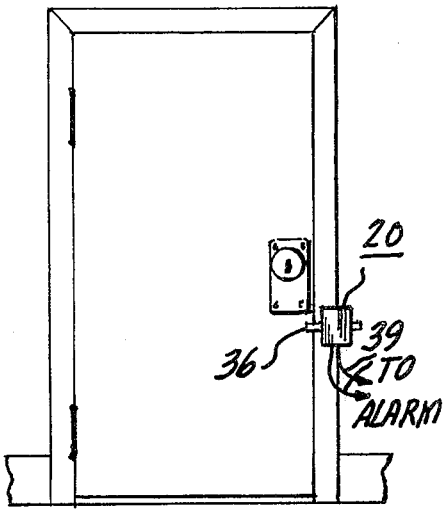
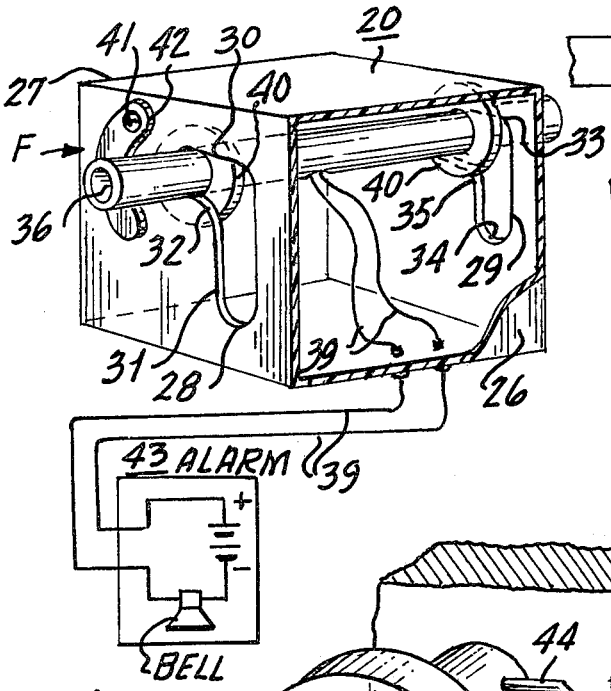
Fig. 2
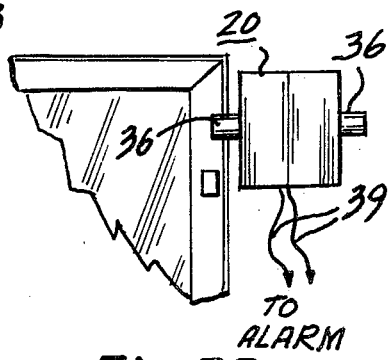
Fig.3B
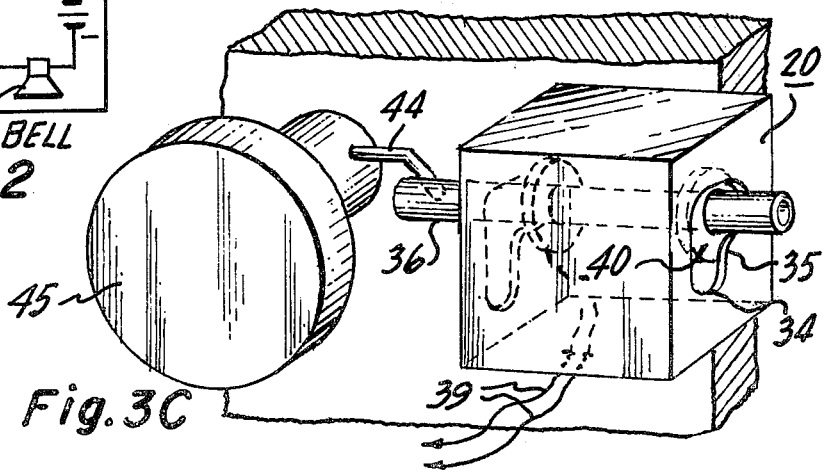
Fig.3C

UNIVERSAL GRAVITY OPERATED INTRUSION SENSING DEVICE

BACKGROUND OF THE INVENTION

This invention relates to instrusion sensing devices and in particular to a device which utilizes a mercury switch for activating an alarm upon receipt of an intrusion action. A mercury tilt switch is well known in the art and there is an abundance of known configurations. Typically, the switch consists of an envelope containing a pool of mercury and a pair of spaced apart electrodes. The pool of mercury is free to move within the envelope and can be directed into contact with the electrodes to provide a closed state or moved away from the electrodes to provide an opened state. A great many of such switches have at least two modes of operation, as described. When an electrical circuit is connected to the switch, the circuit can be controlled according to switch operation, as is known in the art.

Each mercury switch has a characteristic feature known as the "tilt angle", which describes the angle of movement or tilt of the switch that is necessary before the mercury will change position in the envelope and open or close the circuit. A mercury switch can be designed with different tilt angles according to the preference and needs of the user, although the more sensitive switches, i.e. those having small tilt angles, tend to be more expensive to construct.

The use of mercury tilt switches to detect movement of an object to which the switch is affixed is well known in the art. One such prior art device is disclosed in U.S. Pat. No. 3,818,161 entitled AUTOMATIC FLOATING GRAVITY CONTROLLED MERCURY SAFETY SWITCH WITH RESET MEANS issued on June 18, 1974 to J. Rickey, and involves the use of a mercury switch pivotally mounted so as to coact with a weighted ball that is responsive to the tilt of a vehicle chassis. A similar device, shown in U.S. Pat. No. 3,371,171 entitled IGNITION CUT-OFF DEVICE issued on Feb. 27, 1968 to C. Gregory, utilizes multiple chambers for the movement of mercury to produce the desired on-off effect when a vehicle chassis is tilted. U.S. Pat. No. 3,927,287 entitled SENSOR UNIT, issued on Dec. 16, 1975 to C. Hopwood, discloses a mercury switch encapsulated in a floating container which detects changes in the velocity of an automobile to which it is affixed.

Mercury switches have been employed in security systems to detect opening and closing of doors, windows and in various other configurations to detect movement, vibration as well as many other conditions. All such applications require associated structure cooperating with the switch to provide controlled operation according to the nature of the intrusion.

There are other types of vibration detecting devices that do not rely on mercury tilt switches. U.S. Pat. No. 4,185,180 entitled VIBRATION SENSING DEVICE, issued on Jan. 22, 1980 to F. Anderson discloses a pair of electrically conductive plates, each having an annular track and an electrically conductive bar mounted between the tracks and which leaves the surface of the tracks in response to external vibration.

In spite of the plethora of prior art devices, there is a need for an intrusion sensing device of a simple construction which can be activated by a plurality of different types of forces including vibration and translational and rotational movement and which can be adjusted to react to various magnitudes and directions of force without modification to the mercury switch itself.

Furthermore, mercury tilt switches are subject to being deactivated by the reverse of the movement that they are intended to detect, thus cutting off the signal or alarm that has been given. In many applications, it is furthermore desired to the user of an intrusion alarm device that the device, once "tripped", remains so in order that the user may determine the point of intrusion. To overcome this inherent deficiency in mercury tilt switches, prior art inventions have incorporated springs or other means such as electrical interlock devices to counteract the effect of the reversal of movement. Examples are contained in Rickey and Gregory described above. When such features are included, the intrusion switch necessarily becomes more costly and complicated to manufacture. In addition, counter-measures of the type described above are added sources of malfunctioning and require servicing in order to insure that the operational integrity of the system is maintained.

In order to overcome certain deficiencies of the prior art devices, it is the object of the present invention to provide an improved intrusion sensing device which is activated by various types of movement and once activated, will fall to a tripped position and will not become deactivated by a further or reverse movement.

It is a further object of this invention to provide an improved intrusion sensing device which is simple and economical to construct and requires minimal servicing.

Another object is to provide an intrusion sensing device that is easy to install and can be readily adjusted to detect forces of varying intensities.

A further object is to provide a sensing device employing a mercury switch wherein the tolerances of the switch as to tilt angle are circumvented, as the housing means associated with the switch assure desired operation.

SUMMARY OF THE INVENTION

This invention utilizes a mercury tilt switch and a housing having a novel configuration. The housing supports the switch, which may be coupled to a control rod, in either a first or a second position. These positions correspond to different operating modes of the switch. The housing permits the switch to move in response to an external force from the first position and to fall under the influence of gravity as constrained by the housing to the second position. The second position defines a reference plane where the switch comes to rest manifesting a distinct operating mode as compared to the operating mode indicative of the first position.

BRIEF DESCRIPTION OF THE DRAWINGS

FIG. 1 is a front elevation view of an intrusion sensing device according to this invention;

FIG. 2 is a perspective view of the intrusion device of FIG. 1;

DETAILED DESCRIPTION OF THE INVENTION

Figure 4:
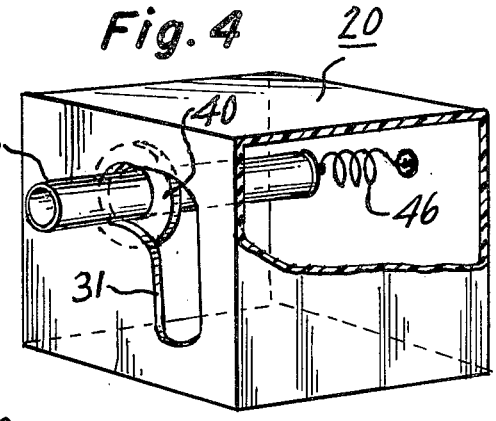
FIG. 4 is a perspective view of an alternate embodiment of the invention.

The gravity operated intrusion sensing device 20 as shown in FIGS. 1 and 2 consists of a housing 21 having sides 22 and 23, a top 24, a bottom 25 and a front 26 and a back 27. Essentially, the housing 21 is a hollow cube, but other geometrical configurations will suffice as will become apparent. The housing 21 can be fabricated from a wide variety of materials such as plastic, metal and so on.

As shown in FIG. 2, slide-slots 28 and 29 are located in opposite sides 22 and 23 respectively and are generally of an inverted "L" shaped configuration. Although slide-slots 28 and 29 are of a similar shape, the vertical portion 31 of slide-slot 28 is longer than the vertical portion 34 of slide-slot 29 such that a line drawn through the bottom edges of the vertical portions 31 and 34 forms an angle with the horizontal that is always greater than the tilt angle of a mercury switch 37 used in this device (FIG. 1). It should be apparent that as an alternate, the vertical portion 34 of slide-slot 29 could be longer than the vertical portion 31 of slide-slot 28. In this manner, the rod when dislodged and hence falls, is always at a given angle within the vertical portion of the slide-slots.

As shown in FIG. 1, a control rod 36 comprises an elongated tube suitable for closely containing a mercury switch 37 positioned therein and leads 39 are connected to the electrodes 38 of said switch 37. The switch 37 need not be contained within the control rod 36, but could be coupled to it such that both elements move simultaneously. Alternatively, the switch 37 may be used without a rod 36 and hence, the envelope of the switch which is generally cylindrical can be employed to project through the slide-slots 28 and 29 and itself used as a rod. According to the embodiment as shown in FIG. 1, the control rod 36 is positioned within both slide-slots 28 and 29 so that the ends protrude from the housing 21. The control rod 36 is movably affixed to the housing 21 by "O" rings 40, washers or any other suitable device coupled to the control rod 36 within the hollow of the housing 21.

The switch 37 and the control rod 36 are in a first top position, as shown in FIG. 2, where the control rod 36 is at rest upon the relatively horizontal portions 30 and 33 of slide-slots 28 and 29. In this position, the switch 37 is constrained in one operating mode. If, as shown in FIG. 2, a force F were imparted to the rod 36 in a direction to move the rod to the right, the rod 36 will fall under the influence of gravity to a second position at the bottom of the slide-slots 28 and 29. In this second position, the rod must assume a predetermined tilt angle C, which angle C is always sufficient to cause the switch 37 coupled to the rod 36 to be operative in a second operating mode. While the force F in FIG. 2 is shown in the horizontal plane, any angled force having a vectorial component in the horizontal plane and directed as shown, will operate to move the rod into the descending portions 32 and 35 of slide-slots 28 and 29, and once moved, the rod 36 falls to the second position under the influence of gravity.

Referring to FIGS. 3A and 3B, the device 20 is positioned on a surface adjacent to a door, window or other opening which is to be monitored and affixed to the surface by screws or other means such as adhesive material. The device is so situated that the edge of the door or window, when opened, will strike the control rod 36, causing it to fall under the influence of gravity to the bottom of vertical portions 31 and 34 of slide-slots 28 and 29. As seen in FIG. 3C, the device may also be positioned perpendicular to the surface of a door and adjacent to a door handle 45 on which is mounted a cam surface 44. Rotation of the handle 45 will cause the cam 44 to move the control rod 36, thus activating the device 20.

Figure 3D:
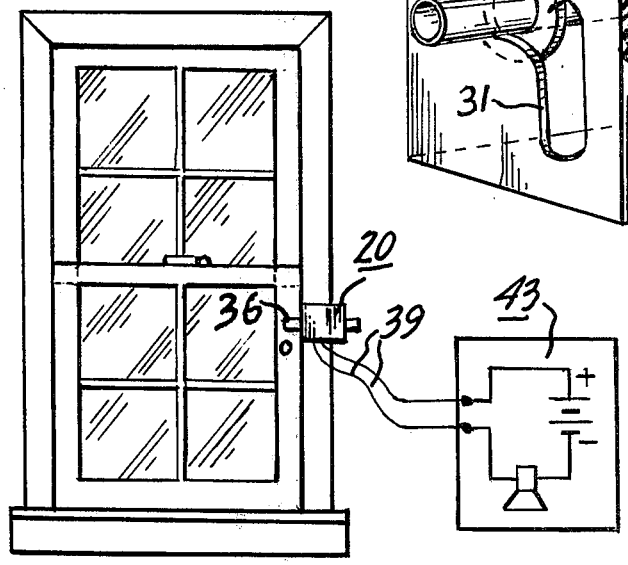
FIGS. 3*a, b, c* and *d* are illustrations of the various ways in which the intrusion sensing device may be mounted to monitor different types of intrusion conditions.

The device 20 may be further utilized as a vibration sensor, as shown in FIG. 3D by attaching it to the surface of the door or window directly. External vibration such as from striking will be trransmitted via the housing 21 to the control rod 36 causing it to move to the second or the "tilt" position.

The rod 36 is free to move as constrained by the slots in the housing from the rest position at the top portions 30 and 33 of the slide-slots 28 and 29 toward the slide incline portions 32 and 35. Hence, the rod 36 will move if the housing 21 is accelerated due to any force applied in a proper direction. Once the rod 36 moves sufficiently, it will, of course, fall to the second position and remain there until a user resets the device by manually moving the rod 36 back to the rest position. The leads 39, as shown in FIG. 2, are connected to an audible, visual or other type of alarm and hence, when the switch 37 is in the second position, the alarm is activated and will remain activated until the device is reset. It is, of course, understood that the alarm circuit 43 may include a suitable timing circuit which will automatically disconnect the alarm after a predetermined period.

As can be further seen from FIG. 2, there is shown an adjustable latch 42 operative to control the position of the rod 36 at different points along the top horizontal portion 30 of slide-slot 28. The latch 42 is a thin, planar member having a curvilinear shape rotatably mounted in the housing by a screw 41. Counterclockwise rotation of the latch 42 causes the control rod 36 to be positioned closer to the incline portion 32 of the slide-slot 28. The screw 41 allows the latch to be adjusted in any position. The latch 42 can also be used to secure the control rod 36 against any movement by rotating it clockwise until it abuts the control rod 36. The latch 42 can be fabricated from any rigid material by means such as stamping that are well known in the art.

It is understood that any other device such as a screw and cam mechanism can be employed to position or set the rod 36 closer or further frm the inclined portion of the slide-slots. Accordingly, the closer the rod 36 is positioned at rest to the inclined portion of the slots, the less force is necessary to cause the rod to move and consequently to fall. The device 20 therefore can operate to detect extremely large or small forces depending upon the position of the same as adjusted.

An alternate embodiment of the device 20 is shown in FIG. 4, wherein the end of the control rod 36 which is not positioned in the slide-slot 31, is supported by a loosely coiled spring 46 which serves to merely constrain the rod within the housing, but allows the rod, when moved, to freely fall within the single-slide slot 31. Accordingly, the angle of tilt available in the embodiment according to FIG. 4 is even greater than that shown in FIG. 1.

Figure 5:
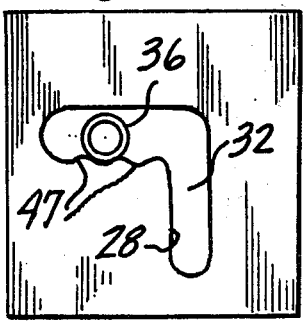
FIG. 5 is a side view of another embodiment of the invention.

According to further considerations as seen in FIG. 5, the surface of slot upon which the rod rests in the first position may contain a serpentine configuration 47, defining a series of indentations or notches into which the rod 36 is set, thus requiring a given predetermined force to dislodge the rod and cause it to move into the inclined portion 32 of the slide-slot to cause it to fall to the second position indicative of the alarm operating mode. It is understood that the weight of the rod and the switch coupled thereto will also determine sensitivity and therefore it should be apparent that the device is universally capable of accommodating a wide range of forces in varying directions of a wide range and degrees of magnitudes.

The control rod 36 can be fabricated from a tube of flexible material cut to the desired length and having an inside diameter that can accommodate a mercury switch 37. The control rod material should be sufficiently rigid to cause the rod to move when struck by a door or window being opened. The mercury switch 30 is a conventional tilt type configuration which is well known and available in the art.

In summation, the device depicted is extremely simple to construct as it has few parts. The operaton of the device is independent of the tilt angle of a particular mercury switch. Due to the nature of the slots, any tilt angle can be accommodated to assure operation. Thus, the mercury switch 32 can be a "reject" switch available from manufacturers at extremely low prices, due to the fact that they do not meet tilt angle requirements.

Figure 6:
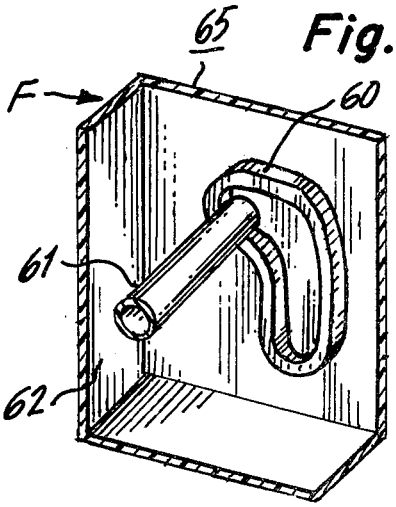
FIG. 6 is a perspective view of another embodiment of the invention.

While the slotted housing configuration is extremely simple to construct, it will be understood that a housing 65 can contain an "L" shaped flange 60 arrangement on the inner walls in which the rod or switch 61 can be positioned as shown in in FIG. 6. In this embodiment, a force imparted to the housing backwall 62 will cause the rod to move as above described and thence to fall under the influence of gravity. The rod 61 can be returned to the rest position (as shown in FIG. 6), by a manual tilting of the housing 65 to thus return the rod 60. In this embodiment, the housing 65 may be removably mounted in a bracket to allow resetting.

The uses and applications of the device are numerous. For example, the device can operate as a door alarm and actually be used to detect knocking and hence, inform a user that someone is at the door. In this manner, the device can serve a dual function by operating both as a conventional door alarm and as an intrusion alarm for the same door or entrance being monitored. The device has applicability as a detector in any environment as in an automobile, home, office or any facility where it is desired to monitor and detect an undesired motion during a time when the premises or the object is to be secured.

Due to the flexibility of the rod 36 when it is restrained to inhibit operation by the latch or other device, it does not interfere with normal operation of the door. When the rod is in the "tilted" or operating position, the angle causes the rod to project a smaller distance from the side of the housing to further prevent interference.

Hence, the applications are deemed to be completely contingent upon the imagination of the user and those skilled in the art may become aware of many additional uses as well as alternate structure encompassing the same principles of operation and all such modifications and uses are deemed to be encompassed within the spirit and scope of the claims appended hereto.

What is claimed is:

1. A gravity operated intrusion sensing device comprising a mercury tilt switch having at least two modes of operation and a housing means to movably support said switch in a first position to produce a first operating mode and to enable said switch to move in accordance with an applied force from said first position and fall freely under the influence of gravity as constrained by said housing to a second position manifesting a reference plane indicative of tilting said switch to produce a second mode of operation.

2. A gravity operated intrusion sensing device comprising a mercury tilt switch having at least two modes of operation and a housing having a side containing a slide-slot, said slide-slot describing a surface for supporting said switch in a first and a second position so that said switch can be moved by an external force from said first position and fall under the influence of gravity as constrained by said housing to said second position manifesting a given tilt angle to produce a different mode of operation of said switch from said first position.

3. The device as recited in claim 2 further comprising a movable control rod coupled to said switch and adapted to be positioned in said slide-slot for movement from said first to said second positions.

4. The device as recited in claim 2 further comprising means coupled to said switch for adjusting the responsiveness of said switch to an external force while in said first position.

5. A gravity operated intrusion sensing device comprising a housing having an internal hollow, with a sidewall containing a slide means of a relatively inverted "L" shaped configuration having a horizontal arm and a vertical arm, and switch means capable of operating in a first and a second mode, said switch means movably positioned in the hollow of said housing, a portion of said switch means positioned on the horizontal arm of said inverted "L" slide means in a first position to produce said first operating mode, said switch means as positioned capable of moving, upon application of a force, toward said vertical arm of said inverted "L", to thence fall under the influence of gravity as constrained by the housing to a second position, said slide means providing a predetermined tilt angle to cause said switch means to produce said second operating mode.

6. The sensing device according to claim 5 wherein said slide means comprises a slot having said inverted "L" shaped configuration, and said switch means comprises a control rod rigidly coupled to a mercury tilt switch, one end of said control rod movably positioned in said slot, and means coupling the other end of said control rod to said housing, such that the control rod will move from said first position and thence fall to said second position under the influence of gravity to cause said switch as rigidly coupled to said control rod to provide said second operating mode.

7. The sensing device according to claim 6 wherein said means coupling said other end of said control rod includes a second slot of a corresponding configuration to said first recited slot, with the vertical arm of said second slot being of a different length than the vertical arm of said first recited slot, said other end of said rod being positioned in said second slot to cause said rod, when at rest after falling under the influence of gravity, to be positioned within said vertical arms of said slots at a predetermined tilt causing said switch to produce said second operating mode.

8. The sensing device according to claim 7 further comprising fastening means coupled to said control rod within said hollow of said housing to prevent removal of said rod from said slots.

9. The sensing device according to claim 5 wherein said slide means comprises a channel positioned on said side wall with said bottom of said switch means movably positioned in said channel and capable of moving under the influence of gravity from said first to said second position.

10. The sensing device according to claim 5 further comprising alarm means coupled to said switch means and operative to provide an alarm signal when said switch means produces said second operating mode.

* * * * *